US011047069B2

(12) United States Patent
Dapsalmon

(10) Patent No.: US 11,047,069 B2
(45) Date of Patent: Jun. 29, 2021

(54) HIGH TENACITY FIBER AND MINERAL REINFORCED BLENDED YARNS

(71) Applicant: Ansell Limited, Richmond (AU)

(72) Inventor: Christian Dapsalmon, Abondant (FR)

(73) Assignee: Ansell Limited, Victoria (AU)

( * ) Notice: Subject to any disclaimer, the term of this patent is extended or adjusted under 35 U.S.C. 154(b) by 177 days.

(21) Appl. No.: 14/451,544

(22) Filed: Aug. 5, 2014

(65) Prior Publication Data

US 2015/0118425 A1 Apr. 30, 2015

Related U.S. Application Data

(60) Provisional application No. 61/898,086, filed on Oct. 31, 2013.

(51) Int. Cl.

| | |
|---|---|
| ***D02G 3/44*** | (2006.01) |
| ***D02G 3/16*** | (2006.01) |
| ***D02G 3/04*** | (2006.01) |
| ***D02G 3/12*** | (2006.01) |
| ***D04B 1/28*** | (2006.01) |

(52) U.S. Cl.

CPC ..... *D02G 3/442* (2013.01); *D02G 3/04* (2013.01); *D02G 3/12* (2013.01); *D02G 3/16* (2013.01); *D04B 1/28* (2013.01); *D10B 2321/0211* (2013.01); *D10B 2501/041* (2013.01); *Y10T 428/1362* (2015.01); *Y10T 428/2913* (2015.01); *Y10T 428/2924* (2015.01); *Y10T 442/438* (2015.04)

(58) Field of Classification Search

CPC ..... D02G 3/04–3/047; D02G 3/02; D02G 33/12; D02G 3/18; D02G 3/182; D02G 3/185; Y10T 428/2913; Y10T 428/2924; Y10T 428/2929; Y10T 442/438

USPC ..... 57/238, 240, 244, 249, 252, 210–224, 57/243–251; 19/145, 145.5

See application file for complete search history.

(56) References Cited

U.S. PATENT DOCUMENTS

| | | | | |
|---|---|---|---|---|
| 5,721,179 | A * | 2/1998 | Shi | A41D 31/0055 428/222 |
| 6,155,084 | A | 12/2000 | Andrews et al. | |
| 8,302,374 | B2 | 11/2012 | Marissen et al. | |
| 2003/0074879 | A1* | 4/2003 | Patrick | 57/229 |
| 2004/0068972 | A1 | 4/2004 | Kanno et al. | |
| 2006/0177656 | A1 | 8/2006 | Kolmes et al. | |

(Continued)

FOREIGN PATENT DOCUMENTS

| | | | |
|---|---|---|---|
| DE | 4221001 | A1 | 1/1994 |
| EP | 0292409 | A1 | 11/1988 |

(Continued)

OTHER PUBLICATIONS

UHMWPE Yarn Colored Polyester Glass Fiber, Sunyang International Trading Co., Ltd., MakePolo.com, URL: http://1012862.en.makepolo.com/products/UHMWPE-YARN---COLORED-POLYESTER---GLASS-FIBER- p25080095.html.

(Continued)

*Primary Examiner* — Jennifer A Steele
(74) *Attorney, Agent, or Firm* — Moser Taboada

(57) ABSTRACT

Cut-resistant and abrasion-resistant yarns including blends of technical fibers and mineral, inorganic, or ceramic fibers of substantially the same length as the technical fibers, and methods for manufacturing yarns, are disclosed.

17 Claims, 3 Drawing Sheets

(56) References Cited

U.S. PATENT DOCUMENTS

| | | | | |
|---|---|---|---|---|
| 2007/0137164 | A1* | 6/2007 | Kolmes et al. | 57/252 |
| 2008/0279514 | A1 | 11/2008 | Kundis et al. | |
| 2009/0183296 | A1* | 7/2009 | Hardee et al. | 2/161.8 |
| 2009/0301139 | A1* | 12/2009 | Kolmes | A41B 11/00 66/185 |
| 2011/0020645 | A1 | 1/2011 | Nakanishi | |
| 2011/0274903 | A1 | 11/2011 | Stuart et al. | |
| 2012/0227158 | A1 | 9/2012 | Ashworth et al. | |
| 2013/0118635 | A1 | 5/2013 | Layson et al. | |

FOREIGN PATENT DOCUMENTS

| | | | |
|---|---|---|---|
| EP | 0564331 | A1 | 10/1993 |
| FR | 2868439 | A1 | 10/2005 |
| JP | 2012515857 | A | 7/2012 |
| KR | 100723432 | B1 | 5/2007 |
| KR | 100723432 | B1 | 5/2007 |
| KR | 20070107725 | A | 11/2007 |
| KR | 20110091554 | A | 8/2011 |
| WO | WO-2004033773 | A1 | 4/2004 |
| WO | WO-2010060943 | A1 | 6/2010 |

OTHER PUBLICATIONS

Northflex Glove Series, North by Honeywell, chipsafety.com, URL: http://www.chispasafety.com/site/wp-content/uploads/2012/07/NorthFlex_Gloves_Catalog.pdf.

Supplementary European Search Report dated Jun. 14, 2017 for Application No. 14857253.0.

Chinese Office Action dated Aug. 11, 2016 for Application No. 201490001140.4.

Australian Patent Examination Report dated Jun. 19, 2017 for Patent Application No. 2014344785.

* cited by examiner

HIGH TENACITY FIBER AND MINERAL REINFORCED BLENDED YARNS

CROSS-REFERENCE TO RELATED APPLICATIONS

This application claims the benefit of U.S. Provisional Application No. 61/898,086 under 35 USC 119(e), Oct. 31, 2013, and is incorporated by reference in its entirety.

BACKGROUND

Field of the Invention

Embodiments according to the present invention generally relate to yarns and, more particularly, to yarns comprising technical fibers and mineral fibers and fabrication methods for forming the yarns.

Description of the Related Art

Abrasion- and cut-resistant yarns are used to manufacture apparel and garments, for many industries, such as construction, industrial, machining, and food-service, as well as households, to protect users from abrasions, cuts, impacts, and other physical injuries. Such apparel includes knitted, non-woven, or woven textiles, such as gloves, capes, jackets, suits, overalls, sleeves, and the like. Often, to impart a required level of protection, the yarns used to manufacture this apparel are thick, heavy, stiff, and uncomfortable, particularly when the yarn directly contacts skin, i.e., sleeves and gloves. Textiles for industrial curtains, draperies, and the like also often require cut- and abrasion-resistance. Gloves and sleeves may especially consist of thick yarns requiring thicker gauge knits, such as 13, 10, and 7 gauge knits, because the denier of the yarn used to make gloves having sufficiently high abrasion- and cut-resistance is typically high, for example, higher than 600 denier. Moreover, typical yarns used for cut-resistance are made from stiffer materials and often include high amounts of fillers, for example, 50% or more. Other materials offering high abrasion- and cut-resistance are blends of yarns and other materials. For example, many cut-resistant yarns comprise stiff materials, such as steel or copper wire. These materials can be very irritating to the skin of users and are typically inflexible. Moreover, such materials are prohibitively expensive for many service applications.

Forming a glove or a glove liner, or other article, that is thin, flexible, and comfortable, without the use of stiff, thick fibers, and maintaining high cut-resistance level has not been possible thus far. Specifically, providing a comfortable, cut- and abrasion-resistant knitted article, using, for example, a blended 70-600 denier yarn has not heretofore been realized.

Therefore, there is a need for inexpensive yarns offering excellent abrasion-resistance, cut-resistance as well as comfort and flexibility and methods of producing articles, such as woven and knitted articles, such as gloves, glove liners, sleeves, and curtains from these yarns, representing a significant advance in the art.

SUMMARY

Yarns comprising technical fibers and mineral fibers, which can be used to manufacture abrasion- and cut-resistant articles, such as gloves, glove liners, sleeves, capes, overalls, curtains and the like, substantially as shown in and/or described in connection with at least one of the figures herein, are disclosed as set forth more completely in the claims. Various advantages and features of the present invention will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

DETAILED DESCRIPTION

Figure 1:
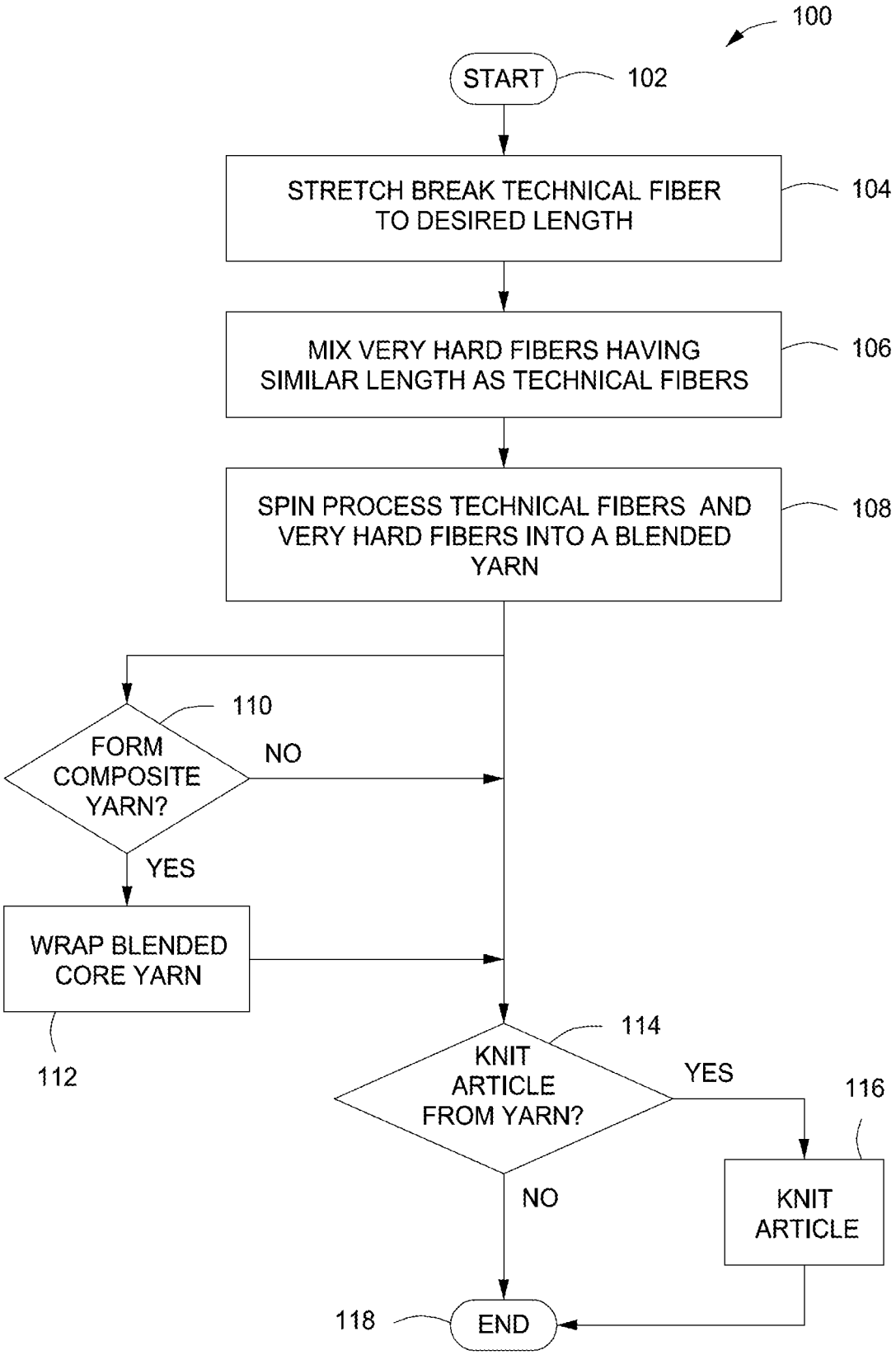
FIG. 1 depicts a flow diagram of a method for producing a blended yarn, according to one or more embodiments of the invention.

Embodiments of the present invention comprise yarns that blend high tenacity fibers and very hard fibers to produce highly cut- and abrasion-resistant, yet inexpensive, yarns. The high tenacity fibers, also called technical fibers, include, for example, chain-extended polyolefin fibers, such as high performance polyethylene (HPPE) and aramids, for example, para-aramids, such as KEVLAR®, meta-aramids, such as NOMEX®, copolyamides, such as TECHNORA®, or combinations thereof and the like while the very hard fibers, i.e., having a Moh's hardness of 3 or greater, include one or more mineral or ceramic fibers, such as glass fibers, silica fibers, basalt fibers, as well as carbon fibers, and the like, or combinations thereof. Moreover, the highly cut- and abrasion-resistant blended yarns according to the invention can be made without expensive fibers, such as DYNEEMA DIAMOND®, marketed by the DSM Corp. Moreover, the use of a stretch-broken process for maintaining a consistent length of the high tenacity fibers results in less fibrillation of the fibers, and is less expensive than a cutting process.

The yarns described above may have additional materials to counteract the effects of laundering wear or to impart comfort. For example, blended yarns according to some embodiments of the invention include nylon fibers and/or elastic fibers, to maintain a very thin, moisture regulating, and flexible structure. Moreover, embodiments of yarns according to the invention include composite yarns. For example, a composite yarn may comprise one or more core fibers wrapped with one or more wrapping yarns.

Gloves disclosed herein have vastly improved abrasion resistance, as measured by Taber and Martindale abraders and test protocols, as well as increased cut resistance. For example, the gloves and/or glove liners, made in accordance with embodiments of the invention, are capable of attaining EN level 4 abrasion-resistance and/or an EN level 2 to 5 cut-resistance. Also, an amount of very hard fibers in the blended or composite yarn can be balanced with an appropriate amount of high tenacity fibers to create a blended and/or composite yarn having a desired balance of hardness and cut- and abrasion-resistance versus tensile properties and cost.

Embodiments according to the invention include wherein the blended or composite yarn comprises high carbon fibers, which may be incorporated into yarns for heat insulation, static dissipation, and/or anti-bacterial properties. In embodiments of the invention disclosed herein, the term "blended yarn" indicates a yarn comprising two or more fibers, such as staple or technical fibers, such as HPPE, and very hard filaments or fibers, such as carbon, basalt, silica, glass fibers, as described above, combined using a spinning process (for example, a wet or dry spun process) to form a blended yarn. In some embodiments, core fibers are wrapped by one or more fibers to form a composite yarn. Where two wrapping yarns are wrapped around one or more core yarns, the two wrapping yarns are wrapped in the opposite orientation as is known to those having skill in the art.

Also, the blended yarns, according to embodiments of the present invention, comprising the technical fibers further comprise the very hard fibers, wherein the very hard fibers have lengths and diameters substantially the same as the technical fibers, which are spun to form a blended yarn. Embodiments according to the invention include wherein the technical fibers and the very hard fibers are approximately the same length and, in some embodiments, from 90-150 mm in length. For example, at least one blended yarn comprises HPPE fibers and mineral fibers each having a mean length of approximately 120 millimeters, wherein the diameter of the mineral fibers ranges from 3 to 10 microns and the technical fiber diameter ranges from 1 to 5 denier, which are substantially similar. Also, at least one exemplary embodiment of the blended yarn comprises HPPE fibers and glass fibers having a mean length of approximately 100-120 millimeters, wherein the mineral fibers, such as glass fibers, comprise between approximately 2% and 40% of the blended yarn. At least one exemplary blended yarn according to the invention comprises a 200 denier yarn having 90% HPPE and 10% glass fibers and is wrapped with 2×-50 denier polyamide wrapping yarns, resulting in a 330 dtex composite yarn. Also, another blended yarn according to the invention comprises a 160 denier filament having 90% HPPE and 10% glass fibers and a 2×-50 denier polyamide wrapping yarn, resulting in a 289 dtex composite yarn.

In addition, at least one embodiment of the present invention includes two or more different technical fibers in one yarn, e.g., a blended yarn comprising both HPPE and para-aramid fibers. Moreover, more than one hard fiber may be used in one yarn, for example, a yarn comprising both basalt and glass fibers. Additionally, least one embodiment of the present invention includes two or more different technical fibers and two or more hard fibers, i.e., a blended yarn comprising HPPE and para-aramid fibers, and basalt and glass fibers.

Moreover, any wrapping yarn may further have an elastic filament or fiber incorporated therein, such as SPANDEX®, LYCRA®, or the like as discussed further below. At least one of the embodiments of the invention comprises either of the previous 90% HPPE/10% glass yarns, substituting the wrapping yarns with a high tenacity polyamide or a high tenacity polyester wrapping yarn to produce a 221 denier or less yarn capable of being knitted with an 18 gauge needle and achieving an EN5 cut-resistance. Also, embodiments of the invention comprise a yarn having a stainless steel or HPPE core that is wrapped with a yarn comprising hard fibers, for example, the 289 or 330 dtex yarn comprising 90% HPPE and 10% glass fibers and 2×-50 denier polyamide wrapping yarn.

In at least one exemplary embodiment according to the invention, the HPPE fibers are produced by taking a longer filament and breaking the HPPE fibers into, for example, 90-150 millimeter pieces by a stretch-break process. The very hard fibers, e.g., fiberglass, silica, carbon, or basalt fibers, may then be cut to approximately the same length as the HPPE fibers. The very hard fibers and HPPE are then spun into a blended yarn, for example, by a gel-spun, melt-spun, or dry-spun process as are known to those of skill in the art.

FIG. 1 depicts a flow diagram of a method 100 for producing a blended yarn according to one or more embodiments of the invention. In some embodiments, each and every step of the method 100 is performed. In other embodiments, some steps are omitted or skipped or performed in an order different than that described here. Method 100 starts at process step 102 and proceeds to step 104. At step 104, the technical fibers, for example, the HPPE fibers, are formed by taking an HPPE thread and stretching the thread until it breaks into fibers having a desired length, for example, 90-150 millimeters. At step 106, very hard fibers, such as mineral fibers are provided. The mineral fibers include inorganic, ceramic, or filament fibers, such as basalt, silica, carbon, or glass fibers as discussed above. The very hard fibers, which have a diameter similar to the technical fibers, are cut to the length of the technical fibers discussed above, and are blended with the technical fibers at a desired percentage. The blended yarns, according to the embodiments of the invention comprise, for example, approximately 80-95% technical fibers and approximately 5-20% of very hard fibers. In some embodiments according to the invention, the very hard fibers may comprise up to 40% of a blended yarn.

Exemplary embodiments according to the invention include wherein the mineral fibers comprise approximately 5%, 7.5%, or 10% of the blended yarn. This range of very hard fibers, particularly glass fibers, is generally favorable to avoid breaking the fibers during processing and use. Nonetheless, other ranges are suitable for varied in-service applications. Also, embodiments of the invention comprise a two-ply yarn, such as one yarn having a composite yarn, for example, HPPE/fiber core yarn, wrapped with a HPPE/SPANDEX®, yarn, or vice-versa, for example, or other processes to combine yarns known to those of skill in the art. Also, fiber contamination can result during knitting processes, which can be avoided using the composite yarn as a core yarn, wrapping it with another yarn, for example, HPPE, KEVLAR®, SPANDEX®, or other yarns. Composite yarns having a core and a wrapping yarn may be made, for example, using the technologies disclosed in commonly-assigned, U.S. Pat. Nos. 8,074,436 and 5,423,168, each of which is incorporated by reference in entirety. Also, in at least one embodiment of the invention, a composite comprises a continuous stainless steel yarn in its core The method 100 proceeds to step 108, at which point the mixture of the HPPE and fibers or filaments are spun processed into a blended yarn. For example, the HPPE and para-aramid fibers and, for example, glass fibers are mechanically mixed or compounded. The HPPE and para-aramid fibers then have the glass fibers embedded therein, at which point the HPPE, para-aramid, and glass fibers are drawn and twisted into a yarn of, for example, less than 100 denier, 221, 309, 400 and to approximately 600 denier. Embodiments according to the invention include melt-spun, wet-spun, or dry-spun processes as are known to those in the art. Optionally, before the method 100 proceeds, the blended yarn may form a composite with another yarn(s), for example, a composite yarn comprising a core yarn and one or covering yarns, as discussed in greater detail below.

The method 100 next proceeds to step 110, and a decision is made whether to knit an article, e.g., a glove, glove liner, or sleeve, or the like from the blended or composite yarn. If the answer is no, the method 100 ends at step 114. If yes, an article is knitted from the blended or composite yarn, for example, using 13, 15, or 18 gauge needles, such as with an automatic knitting machine manufactured by the Shima Seiki, Mfg., Ltd. Co., i.e., Single Whole Garment models, or flat-knitting models or similar knitting machines. A polymeric, elastomeric, or latex coating may be optionally disposed on the liner (or sleeve or other article) as discussed below.

Figure 2A:
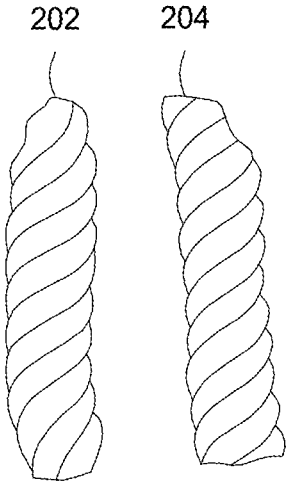
FIGS. 2A-2D depict blended yarns and composite yarns, according to embodiments of the invention.

FIGS. 2A-2D depict blended yarns and composite yarns, according to embodiments of the invention. FIG. 2A depicts a blended yarn 202 according to embodiments of the invention. The composite yarn 202 comprises technical fibers, such as HPPE and very hard fibers, such as reinforcing fibers, such as include inorganic, mineral, ceramic, or filament fibers. Reinforcing fibers include glass fibers, carbon fibers, and/or basalt fibers, as discussed above. Embodiments according to the invention include wherein, as above, the HPPE fibers are 120 millimeters in length and the glass and/or basalt fibers are approximately 120 millimeters in length. The composite yarn is twisted in a Z-configuration, as shown, during processing, but also may be in an S-configuration as is known to those in the art. FIG. 2A also depicts a blended yarn 204, according to embodiments of the invention, and comprises, for example, a Z-configuration or an S-configuration, as shown. The blended yarn 204 may be the same as the blended yarn 202 or comprise other materials, for example, a SPANDEX® or LYCRA® yarn, a very hard fiber different than the very hard fiber in the blended yarn 202 or other changes in technical fibers or very hard fibers.

Figure 2B:
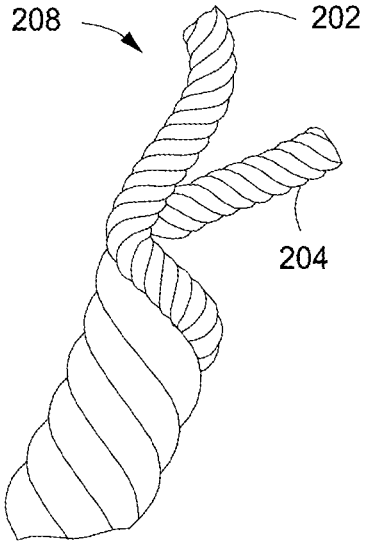

FIG. 2B depicts a two-ply yarn 208, in accordance with embodiments of the invention, which comprises the blended yarn 202 and the blended yarn 204 twisted together in an S-configuration to form a composite yarn 208. As discussed above, each of the blended yarns 202 and 204 can comprise many different technical fibers and many different very hard fibers.

Figure 2C:
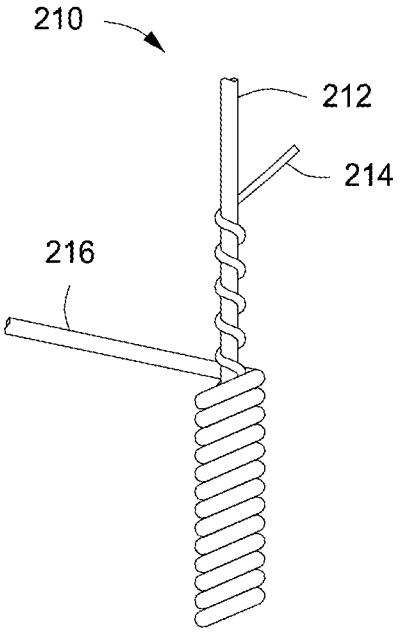

FIG. 2C depicts a three-ply composite yarn 210 comprising a core yarn 212 and two wrapping yarns 214 and 216 in accordance with embodiments of the present invention. The three-ply composite yarn 210 comprises a core yarn 212, a first wrapping yarn 214, and a second wrapping yarn 216. In at least one embodiment of the three-ply composite yarn 210, the core yarn 212 is formed of, for example, a 200 denier yarn comprising 90% HPPE and 10% glass fibers. A first wrapping yarn 214, comprises, for example, a 50 denier polyamide yarn, and is wrapped around the core yarn 212, while a second wrapping yarn 216, comprises a 50 denier polyamide wrapping yarn, and/or an elastomeric yarn, such as SPANDEX® or LYCRA®, which wraps both the core yarn 212 and the first wrapping yarn 214. The first wrapping yarn 214 and the second wrapping yarn 216 are wrapped in opposite directions. At least one other embodiment according to the invention comprises wherein either or both of the first wrapping yarn 214 and second wrapping yarn 216 comprises a high tenacity polyester wrapping yarn.

Figure 2D:
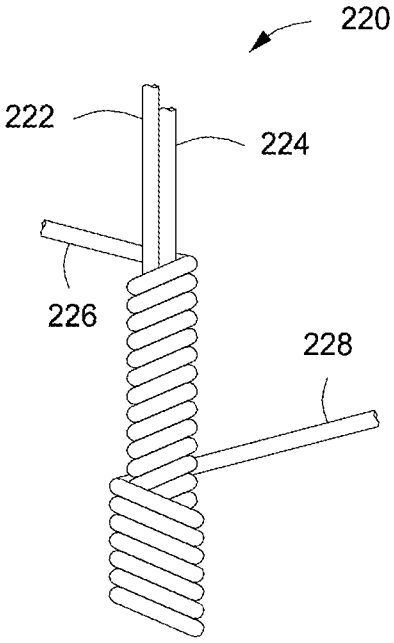

FIG. 2D depicts a four-ply composite yarn 220 comprising a first core yarn 222, a second core yarn 224 and two wrapping yarns 226 and 228, according to embodiments of the present invention. The first core yarn 222 and the second core yarn 224 may parallel to each other or, alternatively, may be twisted or braided together, and are wrapped by the first wrapping yarn 226 and the second wrapping yarn 228, which are wrapped in opposite directions. Any of the first core yarn, second core yarn, first wrapping yarn 226, and second wrapping yarn 228 may comprise, for example, any of the blended yarns described above or any other yarn known to those in the art.

Figure 3:
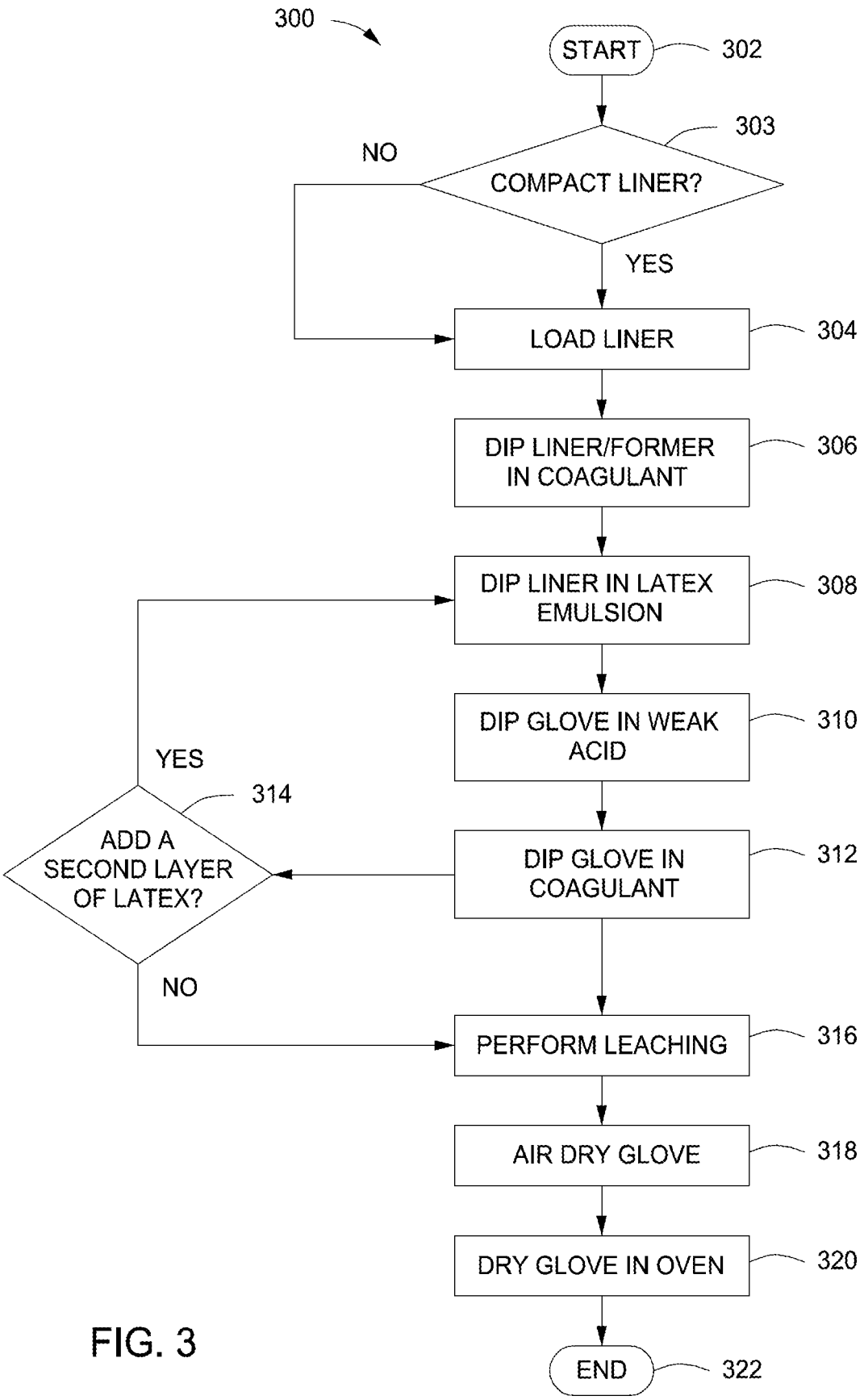
FIG. 3 depicts a flow diagram of a method for producing a glove or glove liner, according to one or more embodiments of the invention.

FIG. 3 depicts a flow diagram of a method 300 for producing a glove or glove liner in accordance with one or more embodiments of the invention. In some embodiments, each and every step of the method 300 is performed. In other embodiments, some steps are omitted or skipped. The method 300 starts at process step 302 and proceeds to step 303. If a supported glove or other knitted article is being produced, a liner is provided on a former as discussed above. At step 303, if a liner is present, the liner may be either a compacted or an uncompacted liner. Compacting, which may be performed separately or optionally, shrinks the liner, thereby increasing the density of the knitted structure. For example, compacting a liner may be achieved by applying a wetting agent to the liner, heating the liner at a first temperature, and drying the liner at a second temperature. The liner is soaked with the wetting agent, heated in, for instance, an oven at approximately 60° C. for approximately 100-120 minutes and subsequently dried at approximately 70° C. for 50-70 minutes.

At process step 304, a liner is loaded onto a former. In some embodiments, the former, which may be made of a ceramic, is heated. At process step 306, the former has a coagulant disposed thereon, for example, by spraying or dipping into a tank having a coagulant, which may be heated to, for example, 40-60° C. In at least one exemplary embodiment of the invention, the coagulant is an aqueous solution of a weak acid, such as acetic acid. Applying a weak acid to the liner results in the polymeric composition, discussed below, sticking very well to the liner with a surprisingly minimal amount of strikethrough to produce an abrasion resistant glove. Stronger coagulants are also possible, such as an aqueous solution of 3 to 15% calcium nitrate concentration.

At process step 308, the former/liner is removed from the tank, dried for approximately 1-5 minutes at, 30-60° C., and has a polymeric, elastomeric, or latex composition applied thereto. The composition may be sprayed onto the liner, screen-printed thereon, or disposed via dipping into a tank having a polymeric, elastomeric, or latex composition, as described below, disposing a polymeric, elastomeric, or latex coating onto the liner. The composition may be applied to the former and liner in one of several ways, such as a full-dip, a ¾ dip, a knuckle-dip, palm-dip or the like, as is discussed herein and as disclosed in commonly-assigned U.S. patent application Ser. No. 12/769,829, which is incorporated by reference in its entirety.

At process step 310, the liner having the polymeric, elastomeric, or latex layer disposed thereon is dipped into a tank having a weak acid for a few seconds to several minutes. Acetic acid, trichloroacetic acid, and formic acid are suitable weak acids. In some embodiments of the invention, the weak acid is an aqueous solution of tricarboxylic acid (TCA) of approximately 0.1-1.0%, as is disclosed in commonly-assigned U.S. patent application Ser. No. 13/928,615, which is herein incorporated by reference in its entirety. The elastomeric or polymeric layer may be dipped in the weak acid, for example, for 2 to 10 seconds.

At process step 312, the glove is optionally dipped into a strong coagulant such as an aqueous solution of calcium citrate, calcium nitrate, ethyl alcohol, methyl alcohol or any mixture thereof or other coagulant salts as are known by those in the art. In some embodiments, the strong coagulant is an 8-12% concentration of calcium citrate, in which the glove is dipped for two to approximately eight seconds and removed. At process step 314, it is determined whether to add a second polymeric layer onto the glove. If the answer is yes, method 300 returns to step 308. Also, the second polymeric layer may be foamed or unfoamed, irrespective of whether the first layer is foamed or unfoamed, and vice versa. If no second layer is to be added, method 300 proceeds to process step 316.

At step 316, the glove is leached of impurities and proteins, for example, 35-50° C. for approximately 1-3 minutes. At process step 318, the glove is allowed to dry in air or with blown air for approximately 30 minutes. At process step 320, the glove is delivered to an oven for drying and curing, for example, at 70-120° C. for 30 to 40 minutes. In some exemplary embodiments, the gloves are dried and cured in one zone of an oven at 70° C. for twenty-five minutes, a second zone at 110° C. for twenty-five minutes, and in a third zone of an oven at 115° C. for approximately twenty-five minutes. At process step 322, the method 300 ends.

As discussed above, the blended yarns and/or composite yarns according to the invention may be used to form a knitted glove or a knitted glove liner. Some embodiments of the invention include elastomeric fibers, filaments, or yarns whether blended with the hard fibers discussed herein or as part of composite yarns. Some embodiments include wherein the blended yarn is disposed within a knitted glove or knitted glove liner so that the blended yarn is closest to the skin of a wearer. Furthermore, a glove or glove liner comprises a blended yarn or a composite yarn in which the blended yarn or composite yarn is within a plaited construction, as is known to those in the art. The blended or composite yarn may be the main yarn or the plaited yarn in such constructions, i.e., knitted articles.

Knitted articles in accordance with embodiments of the invention comprise a coating to form, for example, supported gloves or compression sleeves. For example, a supported glove comprises a polymeric, elastomeric, or latex composition disposed as a layer onto a fabric glove liner, and may be coated either on the outside or inside (skin-contacting) surface with the polymeric, elastomeric, or latex composition. The elastomeric composition comprises natural rubber latex or synthetic rubber latex, as well as other elastomeric polymer materials, for example, but not limited to, natural or synthetic polyisoprene, carboxylated or non-carboxylated acrylonitrile butadiene, nitrile, nitrile-butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, water- or solvent-based polyurethane, anionically stabilized polymer composition, and the like, or mixtures or blends thereof. The polymeric, elastomeric, or latex composition also comprises other additives, fillers, processing aids, vulcanizing agents, rubber accelerators, aqueous and non-aqueous solutions, coagulants, colorants, and the like as known to those in the art.

In some embodiments of the invention, the polymeric composition is foamed, so that air cells dispersed in the range of 5-50 volumetric percentage are formed. When the composition is disposed on a former as a coating, closed cells or open cells may be formed, as is described in commonly-assigned U.S. Pat. Nos. 8,192,834, 8,001,809, and 7,814,571, which are incorporated by reference in their entireties. Foamed polymeric latex layers may penetrate half or more of the thickness of the knitted liner, though the polymeric layer does not penetrate the entire thickness, thereby substantially avoiding strike-through, i.e., skin contact with the polymeric latex. The foamed latex emulsion gels due to the action of the coagulant resident on the surfaces of the yarns forming chocking regions between the fibers, preventing further entry of the foamed latex emulsion into the knitted liner, thus preventing strike-through.

As described herein, a glove is defined as any five-fingered article that is worn on the hand, for example, a supported glove or an unsupported glove. A supported glove is a fabric liner having a polymeric or elastomeric coating disposed thereon. A liner is defined as, for example, a fabric glove (whether woven, non-woven, or knitted) having no elastomeric or polymeric composition disposed thereon, i.e., an unsupported glove. The terms glove and liner may be used interchangeably herein. Likewise, a supported article includes any woven, non-woven, or knitted article, such as a sleeve, having an elastomeric composition disposed thereon. A composite yarn is a yarn comprising a core fiber wrapped by one or more wrapping yarns.

It is further to be noted that any yarn disclosed herein may comprise an antimicrobial agent. The anti-microbial yarn includes anti-microbial ingredients embedded in fibers, such as yarns treated with AEGIS Microbe Shield® technology from AEGIS Environments. Yarns may also be treated with, for example, dichloroxylenol, hexachloraphane; diphenyl derivatives, halogenated hydroxy diphenyl derivatives such as diphenyl ethers for example 2,4,4'-trichloro-2'-hydroxy diphenyl ether (triclosan); and agents such as diacetylamino-azotoluene and triclocarban, TRIOSYN®, 2-propanol, quaternary ammonium compounds, n-halamines, or compounds and combinations thereof, for their anti-microbial properties. Elemental silver, silver-zinc, and silver-copper zeolites are also suitable anti-microbials, as well as other anti-microbials known to those in the art. Any of these anti-microbial substances may also be incorporated within any of the above mentioned elastomeric compositions.

Although a few exemplary embodiments of the invention have been described in detail above, those skilled in the art will appreciate that many modifications are possible in embodiments without materially departing from the teachings disclosed herein. Any and all such modifications are intended to be included within the embodiments of the invention, and other embodiments may be devised without departing from the scope thereof, and the scope thereof is determined by the following claims.

The use of the terms "a" and "an" and "the" and other referents describing embodiments of the invention are to be construed both in the singular and plural unless otherwise indicated or clearly contradicted by context. Ranges of values herein are merely intended to serve as a shorthand method of referring to each separate value falling within the range; unless otherwise indicated herein, and each range value is incorporated into the specification as if individually recited herein. All methods described herein can be performed in any suitable order unless otherwise indicated herein or clearly contradicted by context. The use of any and all examples, or exemplary language (e.g., "such as") provided herein, is intended merely to better illustrate the invention and does not pose a limitation on the scope of the invention unless otherwise claimed. No language in the specification should be construed as indicating any non-claimed element as essential to the practice of the invention.

What is claimed is:

1. A composite yarn, comprising:

a blended core yarn, comprising;

about 90% high performance polyethylene stretch broken technical fibers, and about 10% inorganic, mineral, ceramic, or filament fibers having a length substantially similar to a length of the high performance polyethylene stretch broken technical fibers; and at least one wrapping yarn comprising at least one of a high tenacity polyamide or a high tenacity polyester, wherein the at least one wrapping yarn is wrapped around the core to form the composite yarn having an EN5 cut-resistance level and having dimensions that enable the composite yarn to be knitted with an 18 gauge needle.

2. The composite yarn of claim 1, wherein the technical fibers and the inorganic, mineral, ceramic, or filament fibers comprise a mean length of approximately 90-150 millimeters.

3. The composite yarn of claim 1, wherein the inorganic, mineral, ceramic, or filament fibers comprise at least one of glass fibers, silica fibers, carbon fibers, or basalt fibers.

4. The composite yarn of claim 1, wherein the inorganic, mineral, ceramic, or filament fibers comprise between 2% and 40% of the composite yarn.

5. The composite yarn of claim 1, wherein the denier of the composite yarn is between 70 and 221 denier.

6. The composite yarn of claim 1, that is used to make a knitted article that is at least one of a glove, glove liner, sleeve, or curtain.

7. The composite yarn of claim 6, wherein the knitted article further comprises a coating, the coating comprising a polymeric, elastomeric, or latex composition.

8. The composite yarn of claim 7, wherein the polymeric, elastomeric, or latex composition further comprises at least one of natural polyisoprene, synthetic polyisoprene, carboxylated acrylonitrile butadiene, non-carboxylated acrylonitrile butadiene, nitrile-butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, water-based polyurethane, an anionically stabilized polymer composition, solvent-based polyurethane, or combinations or blends thereof.

9. A composite yarn, comprising:

a blended core yarn, comprising:

about 90% stretch broken technical fibers; and about 10% inorganic, mineral, ceramic, or filament fibers having a length substantially similar to a length of the stretch broken technical fibers; and at least one wrapping yarn comprising at least one of a high tenacity polyamide or high tenacity polyester, wherein the at least one wrapping yarn is wrapped around the blended core yarn to form the composite yarn having a denier of 260 or less and a EN5 cut-resistance level.

10. The composite yarn of claim 9, wherein the technical fibers comprise at least one of high performance polyethylene, para-aramid fibers, meta-aramid fibers, or copolyamide fibers.

11. The composite yarn of claim 9, wherein the inorganic, mineral, ceramic, or filament fibers comprise at least one of glass fibers, silica fibers, carbon fibers, or basalt fibers.

12. The composite yarn of claim 9, wherein the inorganic, mineral, ceramic, or filament fibers comprise between 2% and 40% of the composite yarn.

13. The composite yarn of claim 9, wherein the technical fibers and the inorganic, mineral, ceramic, or filament fibers comprise a mean length of approximately 90-150 millimeters.

14. A knitted article that is at least one of a glove, glove liner, sleeve, or curtain made from the composite yarn of claim 9.

15. The composite yarn of claim 14, wherein the knitted article further comprises a coating, the coating comprising a polymeric, elastomeric, or latex composition.

16. The composite yarn of claim 15, wherein the polymeric, elastomeric, or latex composition further comprises at least one of natural polyisoprene, synthetic polyisoprene, carboxylated acrylonitrile butadiene, non-carboxylated acrylonitrile butadiene, nitrile-butadiene, polychloroprene, polyvinyls, butyl latex, styrene-butadiene (SBR), styrene-butadiene latex, styrene-isoprene-styrene (SIS), styrene-ethylene/butylene-styrene (SEBS), styrene-acrylonitrile (SAN), polyethylene-propylene-diene, water-based polyurethane, an anionically stabilized polymer composition, solvent-based polyurethane, or combinations or blends thereof.

17. A composite yarn, comprising: a blended core yarn comprising about 90% high performance polyethylene stretch broken technical fibers, and about 10% inorganic, mineral, ceramic, or filament fibers having a length substantially similar to a length of the high performance polyethylene stretch broken technical fibers; and at least one wrapping yarn comprising at least one of a high tenacity polyamide or a high tenacity polyester, wherein the at least one wrapping yarn is wrapped around the core to form the composite yarn having an EN5 cut-resistance level, and wherein the denier of the composite yarn is between 70 and 221 denier.

* * * * *